US007179149B2

(12) United States Patent
Chernick et al.

(10) Patent No.: US 7,179,149 B2
(45) Date of Patent: Feb. 20, 2007

(54) SPRING SUPPORTED ILLUMINATED NOVELTY DEVICE WITH SPINNING LIGHT SOURCES

(76) Inventors: Mark Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 44 days.

(21) Appl. No.: 10/944,646

(22) Filed: Sep. 20, 2004

(65) Prior Publication Data

US 2006/0063467 A1 Mar. 23, 2006

(51) Int. Cl.
*A63H 33/22* (2006.01)
*A63H 33/26* (2006.01)

(52) U.S. Cl. ..... 446/242; 417/234; 446/485

(58) Field of Classification Search ..... 446/236, 446/242, 484, 485; 417/234, 363
See application file for complete search history.

(56) References Cited

U.S. PATENT DOCUMENTS 5,190,491 A * 3/1993 Connelly ..... 446/242
5,269,719 A * 12/1993 Klawitter et al. ..... 446/485
6,325,690 B1 * 12/2001 Nelson ..... 446/25
6,413,144 B1 * 7/2002 Williams ..... 446/484
6,454,539 B1 * 9/2002 Santos ..... 417/44.1
6,589,094 B2 * 7/2003 Spencer ..... 446/242
6,743,072 B2 * 6/2004 Nelson et al. ..... 446/490
6,761,466 B1 * 7/2004 Cheng ..... 362/189

* cited by examiner

*Primary Examiner*—John A. Ricci
(74) *Attorney, Agent, or Firm*—LaMorte & Associates

(57) ABSTRACT

A novelty item that spins at least one array of lights to produce a predetermined changing pattern of lights. The device has at least one array of lights that is supported by at least one flexible arm. The arms radially extend from a spinning hub. Consequently, when the arms rotate, the various lights in the array of lights rotate about the hub in a variety of circular pathways. A control circuit is provided in the hub that spins with the arms. The lights in the array of lights are coupled to the control circuit. The control circuit selectively flashes the lights in the array of lights in a manner that is synchronous to the speed at which the various lights are traveling in their circular pathways. As a result, the control circuit can cause the spinning array of lights to produce any desired pattern, display or alphanumeric message.

19 Claims, 4 Drawing Sheets

SPRING SUPPORTED ILLUMINATED NOVELTY DEVICE WITH SPINNING LIGHT SOURCES

BACKGROUND OF THE INVENTION

1. Field of the Invention

The present invention relates to illuminated novelty devices that are used to produce observable patterns of light during low light conditions. More particularly, the present invention relates to such novelty devices where the observed pattern of light is produced from an array of spinning light sources.

2. Prior Art Statement

In the prior art, there are many different types of illuminated novelty devices that produce an observable pattern of light. Such devices are not used for the purposes of illumination, like a flashlight. Rather, such novelty devices are merely used to produce an interesting pattern of light that can be observed during low light conditions. Such novelty devices are commonly sold or distributed at events that are frequented by children and where there are low light conditions. Examples of such events include children's concerts, circuses, amusement parks at night, firework shows and the like.

There is a great variety in the types of illuminated novelty devices that exist. Some illuminated novelty devices use chemical luminescent light sources, where the observed light is created from a chemical reaction. Such chemical luminescent devices, however, cannot be selectively turned on and off once the chemical reaction has started. Furthermore, after a few hours, the chemical reaction ends and the novelty device is incapable of producing light. Furthermore, most chemical compositions used to produce light are toxic. Accordingly, the use of chemical luminescent novelty devices is inappropriate for many young children who may bite or teethe on the device.

Other types of illuminated novelty devices use batteries to provide power to either incandescent bulbs or light emitting diodes (LEDs). Often, to increase the interest of the pattern of light produced by the device, motors are used to move the electric light sources when they are illuminated. One popular type of illuminated novelty device is a device where multiple electric light sources are positioned on the tips of narrow flexible arms. The flexible arms are attached to a hub that is supported by a handle. In the handle is a motor that spins the hub when activated. As such, when a user activates the motor, the hub spins and the lights at the ends of the arms illuminate. The result is a circular pattern of light that is interesting to observe especially in low light conditions.

A problem associated with spinning electric novelty devices is one of play value. Once a child observes the pattern of light emitted by some prior art spinning lights, the child quickly becomes bored with the pattern of light produced. As such, the child no longer is interested in playing with the toy. This is particularly annoying to the parent of the child who just paid a substantial sum of money to buy the spinning light toy.

A need therefore exists for a spinning novelty light that produces a changing pattern of lights that is highly interesting to an observer, especially a child observer, thereby increasing the play value of the device. This need is met by the present invention as described and claimed below.

SUMMARY OF THE INVENTION

The present invention is a novelty item that spins at least one array of lights to produce a predetermined changing pattern of lights. The device has at least one array of lights that is supported by at least one flexible arm. The arms radially extend from a spinning hub. Consequently, when the arms rotate, the various lights in the array of lights rotate about the hub in a variety of circular pathways. A control circuit is provided in the hub that spins with the arms. The lights in the array of lights are coupled to the control circuit. The control circuit selectively flashes the lights in the array of lights in a manner that is synchronous to the speed at which the various lights are traveling in their circular pathways. As a result, the control circuit can cause the spinning array of lights to produce any desired pattern, display or alphanumeric message.

The hub that supports the array of lights is connected to an elongated resilient support that connects the hub to a handle. As the handle is moved, the resilient support bends and the array of lights can be caused to move through a predetermined range of motion relative to the handle as said array of lights spins in its circular pattern. The result is a highly complex pattern of light that is constantly changing and interesting to view.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
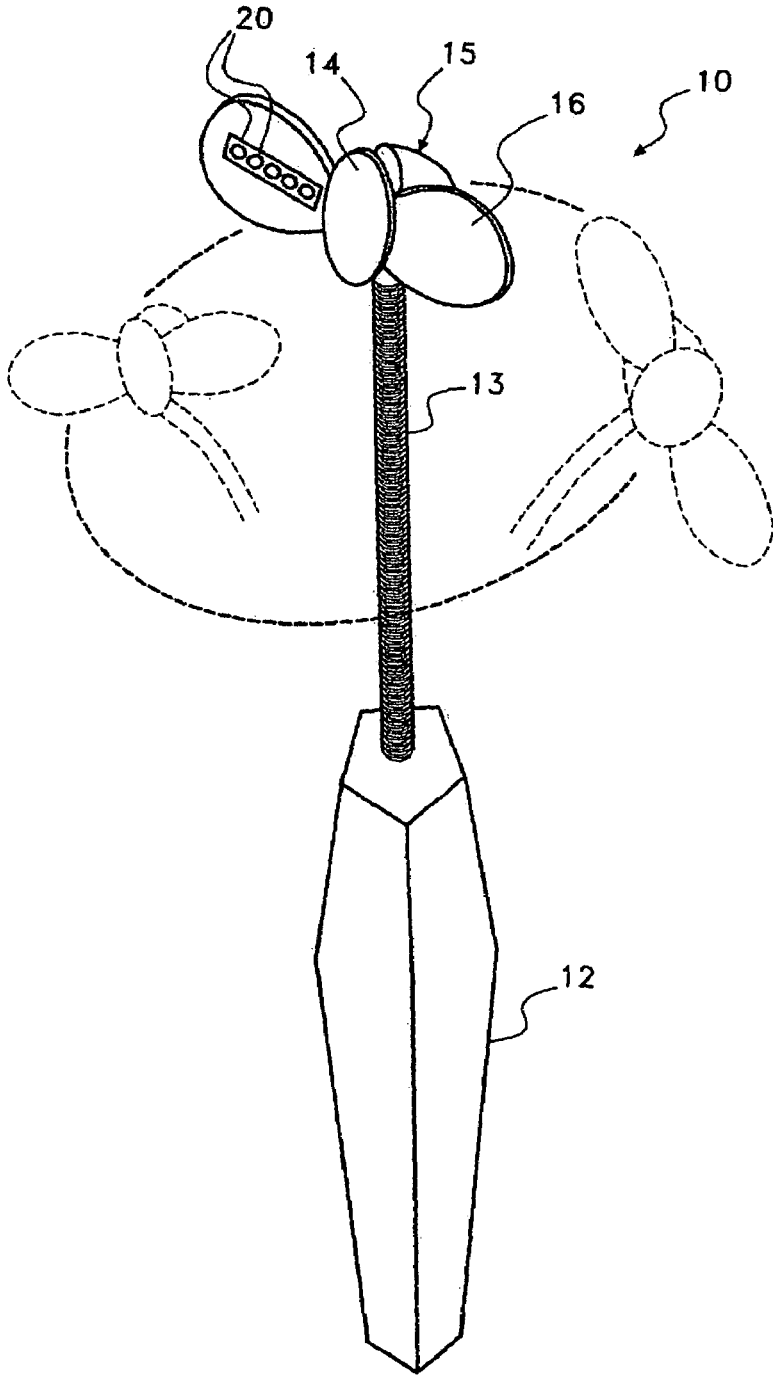
FIG. 1 is a perspective view of one exemplary embodiment of the present invention.

Referring to FIG. 1, a first exemplary embodiment of the present invention device 10 is show. The device 10 contains a handle 12. A resilient support 13 extends from the handle 12. The resilient support 13 has a bottom end that is anchored to the handle 12. However, the opposite end of the resilient support 13 is free, thereby enabling the resilient support 13 to elastically bend in any direction. An illumination assembly 15 is attached to the free end of the resilient support 13 opposite the handle 12. The illumination assembly 15 has a predetermined weight. The resilient support 13 is rigid enough to vertically support the weight of the illumination assembly 15. However, the resilient support 13 is also flexible enough to enable the illumination assembly 15 to swing back and forth and side-to-side when the handle 12 is manually rocked or otherwise shaken. As such, the resilient support 13 allows the illumination assembly 15 to move throughout a predetermined range of motion (RM) relative the handle 12, when the handle 12 is rocked or shaken.

The illumination assembly 15 includes a hub 14. Arms 16 radially extend from the hub 14. In the shown embodiment, two arms 16 extend from the hub 14. However, it should be understood that such a number is arbitrary and any number of arms 16 can be made to radially extend from the hub 14.

The arms 16 can be just flat elements that spin with the hub 14. However, in the shown embodiment, the arms 16 are pitched. As a consequence, the arms 16 act as fan blades when they spin and displace air. This causes the arm 16 to create a flow of air. The flow of air, in turn, creates an opposite and equal force to the illumination assembly 15. It will therefore be understood that when the arms 16 spin, the arms 16 create a force that acts to bend the resilient support 13. Thus, when the arms 16 spin, the arms 16 cause the illumination assembly 15 to move about in the range of motion (RM) even without any manual manipulation of the handle 12.

In the shown embodiment, each of the arms 16 supports a plurality of light sources 20 in a fixed position. The light sources 20 can be incandescent bulbs, but are preferably high-output light emitting diodes (LEDs). The light emitted by the light sources 20 can be any color or combination of colors, depending upon the type of bulbs or LEDs selected. Although five linearly aligned light sources 20 are specifically illustrated on one arm 16, it should be understood that any array of light sources can be mounted on any or all of the arms 16 in any desired configuration.

The hub 14 on the illumination assembly 15 rotates. The arms 16 are attached to the hub 14. Accordingly, as the hub 14 rotates, the arms 16 extending from the hub 14 also rotate. As the hub 14 and arms 16 rotate, current is directed to the light sources 20. Consequently, the light sources 20 illuminate as they spin, thereby producing circular patterns of light. The speed at which the light sources 20 are rotated is known. The light sources 20 are connected to a control circuit that selectively turns on and off the light sources 20 in at least one preprogrammed sequence. The control circuit is synchronized to the speed of rotation for the hub 14. Consequently, as the light sources 20 spin, complex changing patterns of light can be produced. If desired, even alphanumeric messages can be generated.

Figure 2:
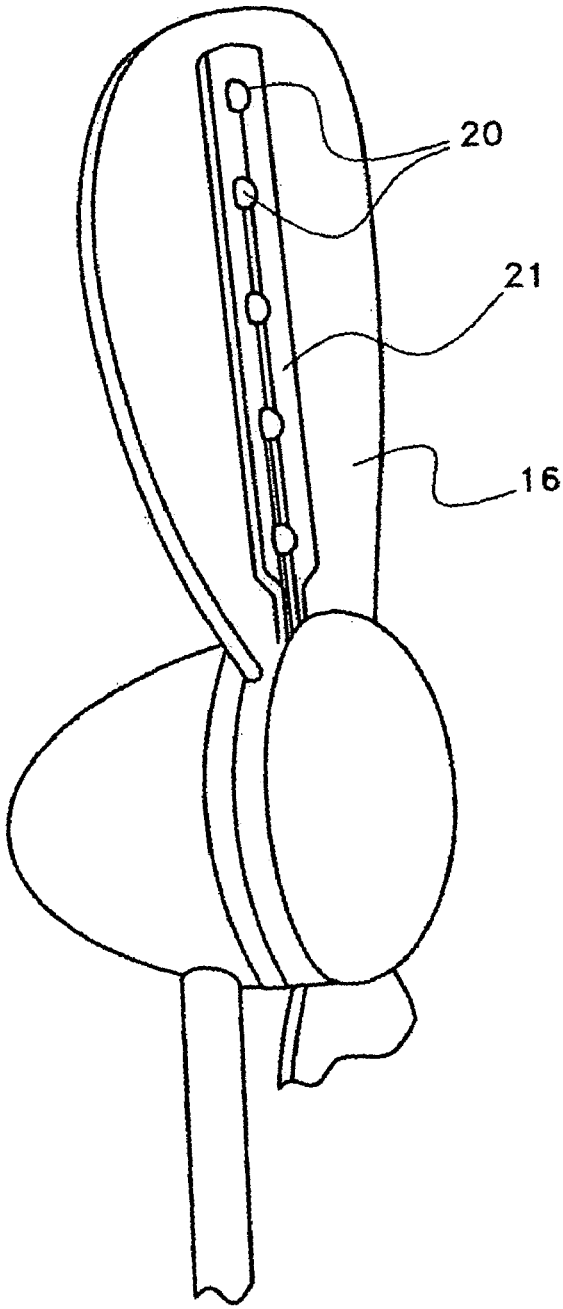
FIG. 2 is a fragmented view of an array of light sources on one arm of the exemplary embodiment.

Referring to FIG. 2, it can be seen that on at least one of the arms 16, the light sources 20 are mounted to flexible circuit boards 21. Each arm 16 is also preferably made of flexible material. The flexible material is preferably an elastomeric material, such as a type of synthetic rubber, silicone or foam rubber. As such, the arms 16 are free to bend and twist even though they contain the circuit boards 21 for the light sources 20. Consequently, the arms 16 are unencumbered by the presence of the circuit boards 21 and the light sources 20.

Since the material of the arms 16 is elastomeric, it provides a natural safety structure. The elastomeric material of the arms 16 surrounds the periphery of the circuit boards 21. Accordingly, if some object, such as a child's face, were to contact the arms 16 as they rotate, the soft elastomeric material of the arms 16 would be the part of the arms 16 that makes contact. Since the material of the arms 16 is soft and flexible, it is not likely to cause injury.

Figure 3:
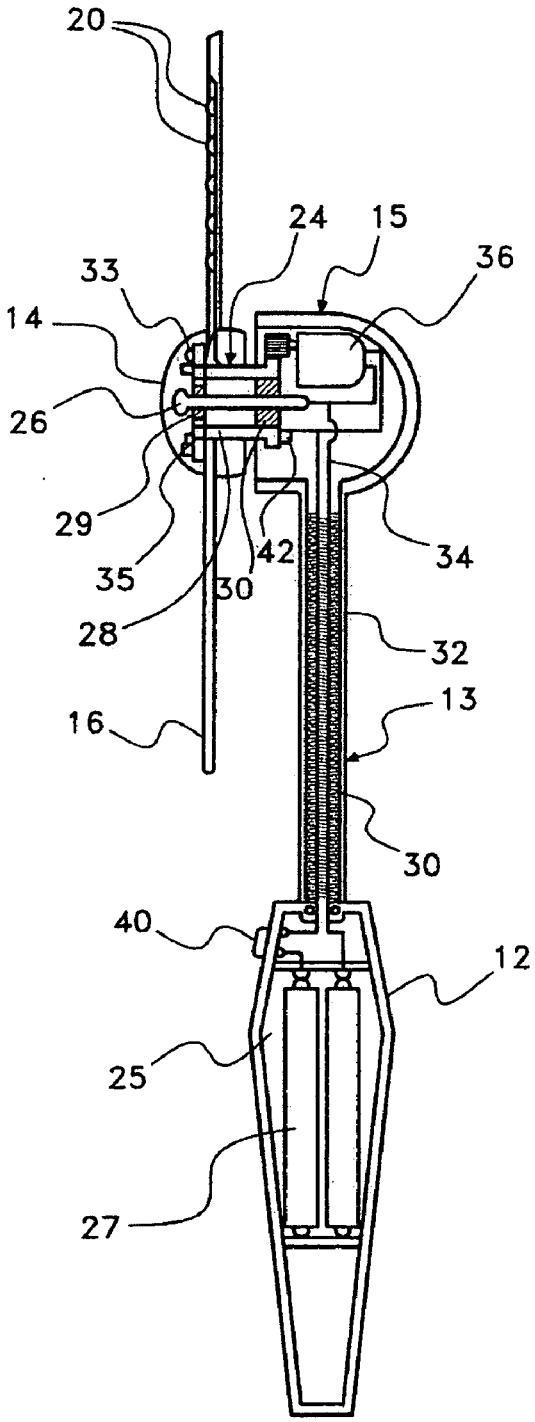
FIG. 3 is a selectively cross-sectioned view of the embodiment shown in FIG. 1.

Referring now to FIG. 3, it can be seen that in the handle 12, there is a port 25 for holding batteries 27. The power from the batteries 27 is used to both illuminate the light sources 20 and rotate the arms 16.

The illumination assembly 15 is supported at the top end of the resilient support 13. From FIG. 3, it can be seen that the resilient support 13 includes a coil spring 30. An optional outer sleeve 32 can be used to cover the spring to prevent the spring 30 from being hyper-extended or becoming tangled in a child's hair. Power is fed to the illumination assembly 15 through wires 34. The wires 34 receive power from the batteries 27 in the handle 12.

In the illumination assembly 15, there is a motor 36. The motor 36 turns the hub 14. A shaft assembly 24 connects the motor 36 to the hub 14. The shaft assembly 24 contains a conductive inner shaft 26 and a conductive outer shaft 28. The inner shaft 26 and the outer shaft 28 are insulated from each other using spacers 30 that are disposed in between the inner shaft 26 and the outer shaft 28. The spacers 30 also act as bearings between the inner shaft 26 and the outer shaft 28. As such, the outer shaft 28 is free to rotate independently of the inner shaft 26.

In the hub 14, there is located a central circuit board 33 that spins around the inner shaft 26. A wiper contact 29 is mounted on the central circuit board 33 that makes electrical contact with the inner shaft 26. A control circuit is mounted to the central circuit board 33 in the hub 14. The control circuit receives one of the leads from each of the light sources 20. The control circuit contains the circuitry that lights the various light sources 20 in at least one predetermined sequence to produce a desired changing pattern of light.

In the hub 14 is also located a second connector 35. The second connector 35 is coupled to both the structure of the hub 14 and the outer shaft 28. The second lead from each light source 20 is coupled to the outer shaft 28, via the second connector 35.

The inner shaft 26 is coupled to one of the wires 34 that lead to the batteries 27. One of the wires 34 is disrupted by an on/off switch 40 that can be manually activated by a person holding the handle 12. Accordingly, a person holding the handle 12 can selectively control the on/off switch 40 and therefore can control the flow of electrical power to the inner shaft 26.

The opposite terminal of the batteries 27 is coupled to a wiping contact 42. The wiping contact 42 presses against the outer shaft 28 of the shaft assembly 24. Accordingly, when the on/off switch 40 is manually closed, a circuit is completed. The circuit starts at one terminal of the batteries 27 and then travels through the resilient support 13 to the illumination assembly 15. In the illumination assembly 15, electricity flows through the inner shaft 26 up to the light sources 20. The circuit then returns to the opposite terminal of the batteries 27 from the light sources 20 through the outer shaft 28, via the wiping contact 42. It should therefore be understood that each time the on/off switch 40 is pressed closed, the light sources 20 illuminate.

The electric motor 36 rotates at a known speed. Accordingly, when the electric motor 36 is activated, the electric motor 36 turns the outer shaft 28, that turns the hub 14, that turns the arms 16. Since the speed at which the electric motor 36 spins is known, the rotational speed of the arms 16 is also known because it is proportional to the speed of the electric motor 36 multiplied by the radius of the arms 16.

The wires 34 that connect the electric motor 36 to the batteries 27 also pass through the on/off switch 40. Consequently, when the on/off switch 40 is pressed, power is supplied to the light sources 20 and power is supplied to the motor 36 that turns the hub 14.

In the shown embodiment of FIG. 1, FIG. 2, and FIG. 3 the array of light sources 20 is a single straight line of LEDs. It will be understood that the array of light sources can be a matrix of LEDs where multiple LEDs are arranged in rows and columns. The use of a single row of LEDs is merely exemplary.

Figure 4:
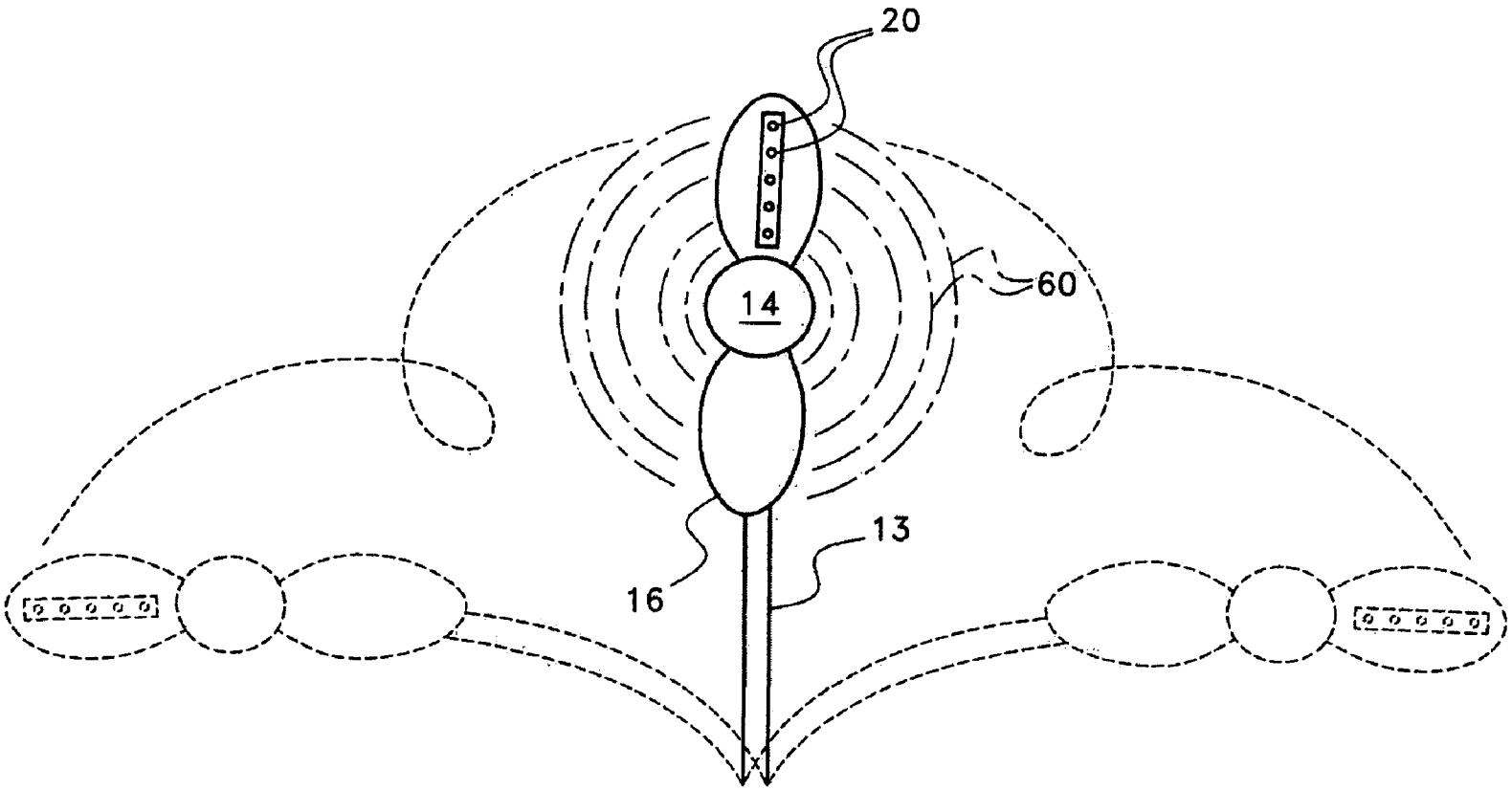
FIG. 4 is a front view of the exemplary embodiment of FIG. 1 as it creates moving patterns of light.

Referring now to FIG. 4, it can be seen that as the light sources 20 rotate, each light source 20 follows its own circular path 60 around the hub 14. The circular path 60 of any one light source 20 depends upon the distance between that light source 20 and the center of the hub 14. There are five light sources 20 shown in the exemplary embodiment. Accordingly, they create only five circular paths 60 of light as they spin.

As the light sources 20 on the arms 16 spin, the control circuit on the central circuit board 33 (FIG. 2) selectively turns on and off the light sources 20 in a preprogrammed pattern. The pattern programmed into the control circuit produces at least one changing pattern of lights. The changing pattern of lights can create a geometric pattern, a recognizable shape, such as Mickey Mouse ears, or alphanumeric characters as the light sources 20 spin.

In order for the array of light sources 20 on the moving arms 16 to produce a readable display, the lighting of the various light sources 20 on the arms 16 must be synchronized with the rate of rotation of the arms 16. If the lighting of the light sources 20 is not synchronized with the movement of the light sources 20, then the pattern or message set forth by the light sources 20 will appear as a blur and will not be readable.

The speed at which the arms 16 spin is a known constant in the present invention. The circular path 60 of each of the light sources 20 is also known. Knowing the speed of rotation and the circular pattern of light 60 of each light source 20, the relative speed of each light source 20 is readily calculated. The control circuit on the central circuit board 33 (FIG. 2) is preprogrammed with the relative speed of each of the light sources 20 on the arms 16. The control circuit can then synchronize the lighting of the various light sources 20 to create a clear display of any preprogrammed pattern and/or message.

In addition to the light sources 20 spinning around the hub 14, the hub 14 can also be moving relative the handle 12. As the handle 12 is manipulated, the resilient support 13 bends. The lights sources therefore not only move in a circular pattern, but also move throughout a complex range of motion RM (FIG. 1). The pattern of light 60 being observed is therefore highly complex and interesting to view. This keeps the assembly interesting to an observer, especially a child observer.

It will be understood that the embodiment of the present invention specifically described and illustrated is merely exemplary and the shown embodiment can be modified in many ways. For example, the number of light sources, the number of arms and the position of the light sources on the arms can be varied in any manner by a person skilled in the art. Furthermore, the shape of the arms, the hub and the handle can be varied. In the shown embodiment, the arms have an elongated shape. This shape can be varied into any shape including recognizable object shapes such as Mickey Mouse arms, dinosaur legs and the like. Additionally, the length and flexibility of the resilient support can be changed to acquire different degrees of movement. All such alternate embodiments and variations are intended to be included within the scope of the claims as listed below.

What is claimed is:

1. An assembly, comprising:

a motor;

at least one fan blade extending from said motor, wherein said motor rotates said at least one fan blade about a central point when activated, whereby said at least one fan blade creates a lateral force when rotated by said motor;

a plurality of light sources supported by said at least one fan blade, wherein at least some of said plurality of light sources are positioned at different distances from said central point;

a handle; and a resilient support extending between said handle and said motor, wherein said resilient support enables said motor and said at least one fan blade to move through a predetermined range of motion relative to said handle.

2. The assembly according to claim 1, wherein said resilient support includes a spring having a first end coupled to said handle and a second end coupled to a housing that holds said motor.

3. The assembly according to claim 2, wherein said spring is surrounded by a flexible protective sleeve.

4. The assembly according to claim 1, further including a control circuit that selectively lights said light sources as they spin to produce a predetermined changing pattern of light.

5. The assembly according to claim 4, wherein said control circuit rotates with said light sources.

6. The assembly according to claim 1, wherein said light sources are light emitting diodes.

7. The assembly according to claim 1, wherein different light sources within said plurality of light sources emit different colored light.

8. The assembly according to claim 1, wherein said lateral force created by said at least one fan blade is sufficient to flex said resilient support.

9. An assembly, comprising:

fan blades;

an array of light sources supported by at least one of said fan blades;

a motor for spinning said fan blades and said array of light sources in a circular pattern, wherein said fan blades create a lateral force when spun by said motor;

a handle; and a resilient element connecting said motor to said handle, wherein said resilient element enables said array of light sources to move through a predetermined range of motion relative to said handle as said array spins in said circular pattern.

10. The assembly according to claim 9, wherein said array of light sources is mounted on a circuit board and said circuit board is mounted on one of said fan blades that is rotated by said motor.

11. The assembly according to claim 9, wherein said resilient element includes a spring having a first end coupled to said handle and a second end coupled to a housing that holds said motor.

12. The assembly according to claim 11, wherein said spring is surrounded by a flexible protective sleeve.

13. The assembly according to claim 9, further including a control circuit that selectively lights said light sources as they spin to produce a predetermined changing pattern of light.

14. The assembly according to claim 13, wherein said control circuit rotates with said light sources.

15. The assembly according to claim 9, wherein said light sources are light emitting diodes.

16. The assembly according to claim 9, wherein different light sources within said array of light sources emit different colored light.

17. A method of producing a spinning light assembly, said method comprising the steps of:

providing a handle;

attaching a resilient support to said handle, wherein said resilient support is elongated, having a first end and a second end, wherein said first end is coupled to said handle;

providing fan blades;

providing an array of light sources that are supported by said fan blades;

providing a motor for spinning said fan blades and said array of light sources in a circular pattern at a predetermined speed of rotation; and attaching said motor with said array of light sources to said second end of said resilient support, wherein said resilient support enables said fan blades and said array of light sources to move through a predetermined range of motion relative to said handle as said fan blades and said array of light sources spins in said circular pattern.

18. The method according to claim 17, further including the step of providing a control circuit for lighting said array of light sources in a predetermined pattern.

19. The method according to claim 18, wherein said control circuit lights said array of light sources in at least one predetermined pattern that is synchronized with said predetermined speed of rotation to produce a coordinated display image.

* * * * *